United States Patent [19]

Keane

[11] 4,107,490

[45] Aug. 15, 1978

[54] HOSPITAL BEDS

[76] Inventor: Francis Xavier Keane, 261 N. Circular Rd., Dublin, Northern Ireland, 7

[21] Appl. No.: 772,063

[22] Filed: Feb. 25, 1977

[30] Foreign Application Priority Data

Mar. 4, 1976 [GB] United Kingdom ..... 445/76

[51] Int. Cl.[2] ..... H01H 3/00; H01H 3/42

[52] U.S. Cl. ..... 200/52 R; 5/61; 5/66; 200/153 LA

[58] Field of Search ..... 5/61, 63, 66, 108, 109; 200/153 LA, 52 R

[56] References Cited

U.S. PATENT DOCUMENTS

| | | | |
|---|---|---|---|
| 2,159,076 | 5/1939 | Douglas | 200/153 LA |
| 3,434,165 | 3/1969 | Keane | 5/61 |
| 3,676,625 | 7/1972 | Blatt | 200/153 LA |
| 3,766,501 | 10/1973 | Hotte et al. | 200/153 LA |

*Primary Examiner*—Casmir A. Nunberg
*Attorney, Agent, or Firm*—Kurt Kelman

[57] ABSTRACT

The present invention relates to hospital beds of the type in which an electric motor is used to produce oscillation of the supporting structure relative to the bed frame. In the present invention there is provided a locking pin to lock the supporting structure at an angle to the bed frame. The movement of the locking pin to lock or to release the supporting structure, is adapted to actuate a switch to the electric motor to cut off or cut in respectively the said electric motor to stop oscillation or produce oscillation of the supporting structure relative to the bed frame.

5 Claims, 2 Drawing Figures

HOSPITAL BEDS

Figure 1:
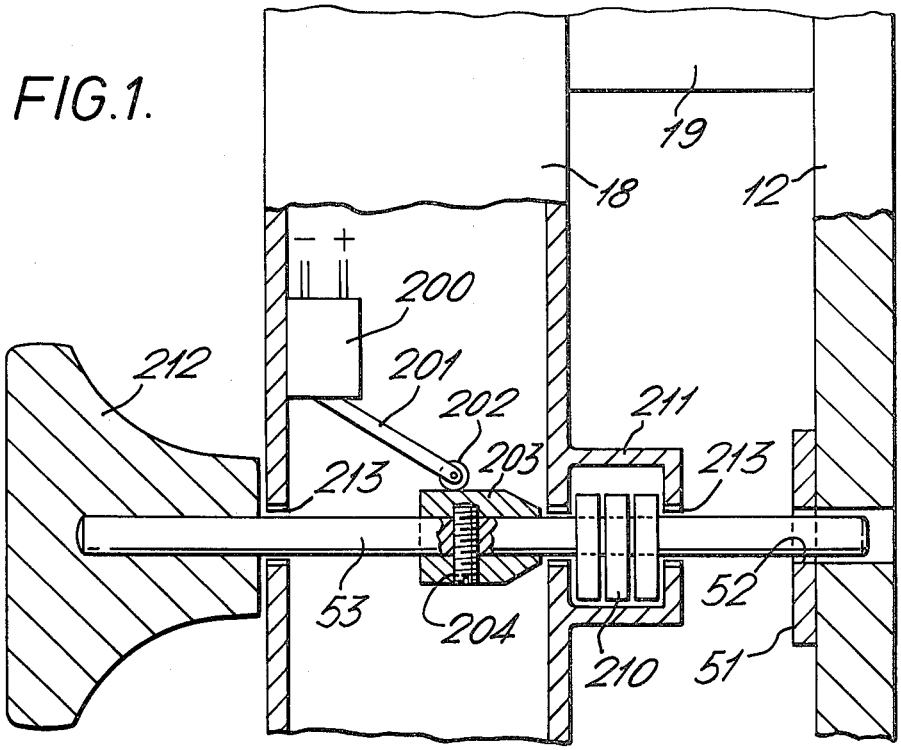

This invention relates to hospital beds, and may be applied in particular to a hospital bed of the kind described in U.S. Pat. No. 3,434,165.

In this bed, the patient-bearing surface (or stretcher) is mounted within supporting structure in the form of a substantially U-shaped keel, and the keel is pivotally mounted at each end in a U-shaped bed frame for oscillation relative to said frame about an axis parallel to the longitudinal direction of the stretcher. The oscillations of the stretcher are produced by an electric motor fixed to the bed frame and driving the stretcher supporting structure through a crank and a detachable connecting rod. A locking pin is provided on the bed frame which may be pushed in to engage any one of a plurality of holes in a locking ring fixed relatively to the supporting structure so that the stretcher may be locked at any desired angle to the horizontal, after the electric motor has been switched off and the connecting rod detached from the crank.

A disadvantage with this arrangement is that there is a tendency for nursing staff, when they become familiar with the operation of the bed, to omit switching off the electric motor, and simply disconnect the connecting rod from the crank while the motor continues to run. They lower the connecting rod onto a rest or stop on the locking ring, turn the stretcher to a desired position, and engage the locking pin in the locking ring which locks the stretcher against rotation. The electric motor continues to run and as the crank turns it impinges upon the connecting rod on its rest. A large strain is thereby produced, seriously damaging the gear unit through which the motor drives the crank, or bending the driving shaft.

According to the present invention there is provided a hospital bed comprising a stretcher mounted in a supporting structure, a bed frame in which the supporting structure is pivotally mounted for oscillation relative to the frame, an electric motor fixed relative to the bed frame for producing oscillation of the supporting structure, and a locking means for locking the supporting structure at a desired angle relative to the bed frame, the bed further comprising an electric switch for the motor which switch is automatically operated by movement of the locking means in such manner that, when the locking means is operated to lock the supporting structure, the motor is switched off and, when the locking means is released, the motor is switched on.

The advantage of this invention when applied to the hospital bed described in the above mentioned U.S. Pat. No. 3,434,165 is that the electric motor is automatically switched off by operation of the locking means, so that the possibility of gearbox or drive shaft damage is eliminated. Furthermore, the invention eliminates the need for a conventional motor operating switch which, when placed for ease of operation, is in practice often accidently switched off or damaged by passing hospital ward traffic. Also, the invention reduces the number of steps in the operation of the bed since now the locking means provides the dual function of locking the bed in position and switching off the electric motor. Preferably, the electric switch effects complete electrical isolation of the motor upon operation of the locking means, thus allowing the motor to be serviced in safety.

Figure 2:
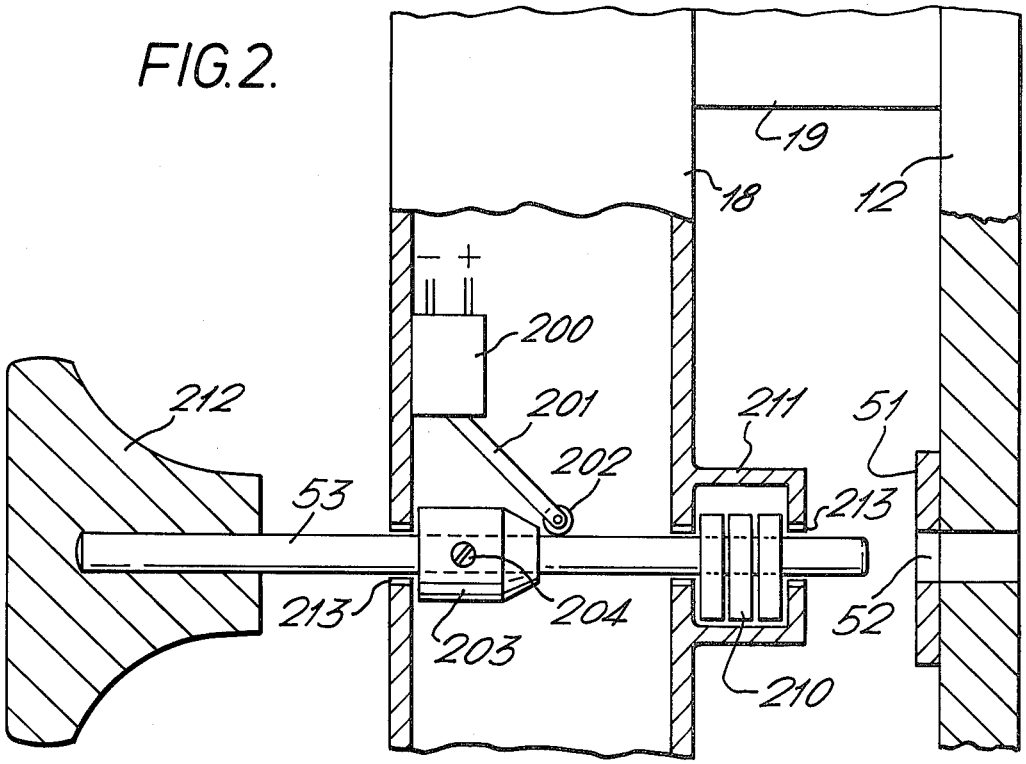

An embodiment of the invention will now be described, by way of example, with reference to the accompanying drawings wherein:

FIG. 1 is a cross-sectional view of a locking arrangement for a hospital bed according to the present invention, showing a locking pin pushed home into a cooperating locking ring, and FIG. 2 is a cross-sectional view of the locking arrangement of FIG. 1 showing the locking pin withdrawn from the locking ring.

Although only the locking arrangement is shown in the drawings, it is to be understood that the hospital bed as a whole may be the same as that described in the abovementioned U.S. Pat. No. 3,434,165, and reference is had to that specification for full details of the bed. In the present specification those elements of the drawings which have a counterpart in the earlier U.S. Pat. No. 3,434,165 have been given the same reference numerals, thus assisting in identifying how the locking arrangement is incorporated in the hospital bed.

Referring now to the drawings, the hospital bed comprises a stretcher (not shown) mounted in a supporting structure in the form of a U-shaped keel 12, and a bed frame 18 in which the keel 12 is pivotally mounted for oscillation relative to the frame 18 about a pivot pin 19. The oscillations are produced by an electric motor (not shown) which is fixed relative to the bed frame 18 and which drives the keel 12 through a mechanical coupling which may be of the kind described in the abovementioned prior patent. A locking pin 53 is mounted in and passes through the bed frame 18 and cooperates with a locking ring 51 fixed relative to the keel 12. By pushing the locking pin 53 towards the locking ring 51 the pin may be inserted into any one of a number of apertures 52 in the locking ring to lock the keel 12 at a desired angle relative to the bed frame 18. This is shown in FIG. 1 herein and in the prior patent. To release the locking pin 53, the latter is pulled away from the locking ring 51 whereupon the pin disengages the aperture 52. This is shown in FIG. 2. The locking pin 53 also passes through a number of friction springs 210 located in a bearing housing 211 welded to the anterior of the bed frame 18. These friction springs 210 maintain the locking pin in the inserted or withdrawn position. A hand knob 212 on the pin 53 outside the bed frame 18 and a ferrule 203 on the pin 53 inside the bed frame 18 act as limit stops for the movement of the pin. The pin slides in press-fit tufnel or nylon bushes 213. Mounted within the bed frame 18, which is hollow in the region of the locking pin 53, is a 2-pole microswitch 200 through which electrical power is supplied to the electric motor. The microswitch is actuated by an arm 201 extending downwardly towards the pin 53. The arm carries a roller 202 at its lower end which cooperates with the ferrule 203, the latter being secured to the pin 53 by a grub screw 204. When the pin 53 is moved to the right into locking engagement with the locking ring 51, FIG. 1, the roller 202 rides up on the ferrule 203 thus raising the arm 201. This switches the microswitch OFF and isolates the electric motor from both the neutral and live side of the power supply. When the pin 53 is moved to the left and disengages the locking ring 51, FIG. 2, the roller 202 runs down onto the pin 53, thus dropping the arm 201. This switches the microswitch ON and supplies power to the electric motor.

It will be appreciated that in the arrangement described, if the locking pin were accidently pushed home, the microswitch will act as a safety switch, cutting off power to the motor and preventing damage to the bed mechanism. If the locking pin is engaged by a nurse or bed operator, the microswitch will act as an automatic switch for the electric motor and eliminates the need for operating a conventional switch before inserting or withdrawing the locking pin. The microswitch also electrically isolates the motor for maintenance.

It will be readily understood that the device also serves the function of a safety switch in the case where the locking pin is accidently engaged while the bed is oscillating. The device also serves to minimise the wear on a safety clutch which is usually incorporated as a standard component in the driving mechanism. The locking pin 53 may carry a suitably shaped cam member which is positively engaged by a spring mounted plunger (the cam member and cooperating plunger are not shown in the accompanying drawings). The envisaged function of the cam member and the cooperating spring mounted plunger is to positively influence the operative forward and backward sliding movement of the locking pin relative to the locking ring to ensure that in use the locking pin is fully inserted into the locking ring or fully retracted from the locking ring as desired. The cam member and the spring mounted plunger are of conventional construction.

What is claimed is:

1. In a hospital bed comprising a bed frame, a supporting structure for a stretcher pivotally mounted in the bed frame for oscillation relative to the bed frame, an electric motor arranged to effect oscillation of the supporting structure relative to the bed frame upon energization of the motor, and means for locking the supporting structure at a desired angle relative to the bed frame, the locking means comprising cooperating elements on the bed frame and the supporting structure respectively, the cooperating elements including one of the elements arranged to assume two selected rest positions respectively in engagement with the other element to lock the supporting structure at the desired angle relative to the bed frame and out of engagement with the other element to release the supporting structure for pivotal movement relative to the bed frame:

(a) an electric switch adapted to control the supply of electrical energy to the motor for energization thereof, and (b) means coupling the electric switch and the one element of the locking means, the coupling means being arranged to switch on the switch automatically to energize the motor when the one element is in the rest position out of engagement with the other element to release the supporting structure and to switch off the switch when the one element is in the rest position in engagement with the other element to lock the supporting structure.

2. In the hospital bed of claim 1, the one element being a pin slidably mounted relative to the bed frame and the other element is fixed relative to the supporting structure and defines a plurality of apertures arranged in an arc centered on an axis about which the supporting structure is pivotally mounted, the pin being in alignment with respective one of the apertures for engagement therewith.

3. In the hospital bed of claim 2, the bed frame defining a hollow region wherethrough the slidably mounted pin passes and the electrical switch being mounted in the hollow region of the bed frame.

4. In the hospital bed of claim 3, the coupling means comprising a ferrule carried by the pin within the hollow region of the bed frame and a member connected to the switch for switching it on and off, the member being in the path of the sliding movement of the ferrule on the pin and being operated thereby.

5. In the hospital bed of claim 4, a hand knob on the pin outside the bed frame, the hand knob and the ferrule constituting respective stops for the sliding movement of the pin into the respective rest positions thereof.

* * * * *